US009136599B2

(12) United States Patent
Su et al.

(10) Patent No.: US 9,136,599 B2
(45) Date of Patent: Sep. 15, 2015

(54) BROADBAND ANTENNA AND WIRELESS COMMUNICATION DEVICE EMPOLYING SAME

(71) Applicant: Chiun Mai Communication Systems, Inc., New Taipei (TW)

(72) Inventors: Wei-Cheng Su, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 159 days.

(21) Appl. No.: 14/014,586

(22) Filed: Aug. 30, 2013

(65) Prior Publication Data

US 2014/0111383 A1 Apr. 24, 2014

(30) Foreign Application Priority Data

Oct. 24, 2012 (TW) ..... 101139311 A

(51) Int. Cl.

| | |
|---|---|
| ***H01Q 1/38*** | (2006.01) |
| ***H01Q 5/01*** | (2006.01) |
| ***H01Q 5/357*** | (2015.01) |
| ***H01Q 5/378*** | (2015.01) |

(52) U.S. Cl.

CPC ..... *H01Q 5/01* (2013.01); *H01Q 5/357* (2015.01); *H01Q 5/378* (2015.01)

(58) Field of Classification Search

CPC ..... H01Q 5/01; H01Q 5/357; H01Q 5/378
USPC ..... 343/700 MS, 702, 829, 846
See application file for complete search history.

(56) References Cited

U.S. PATENT DOCUMENTS

| | | | | |
|---|---|---|---|---|
| 6,008,762 | A * | 12/1999 | Nghiem | 343/700 MS |
| 7,911,387 | B2 * | 3/2011 | Hill et al. | 343/700 MS |
| 8,368,598 | B2 * | 2/2013 | Kuo et al. | 343/700 MS |
| 8,754,817 | B1 * | 6/2014 | Kuo et al. | 343/702 |
| 8,836,584 | B2 * | 9/2014 | Kim et al. | 343/700 MS |
| 8,847,828 | B1 * | 9/2014 | Lee et al. | 343/702 |

* cited by examiner

*Primary Examiner* — Tho G Phan
(74) *Attorney, Agent, or Firm* — Novak Druce Connolly Bove + Quigg LLP

(57) ABSTRACT

A broadband antenna for wireless communication device is disclosed. The broadband antenna includes a main radiator, a grounding unit, a feeding unit, and a resonating unit. The main radiator includes a main radiating portion, a first radiating arm extending from the main radiating portion, and a second radiating arm extending from the main radiating arm, the first radiating arm forms a first current path to generate a first high frequency mode; the second radiating arm forms a second current path to generate a second high frequency mode. The resonating unit is connected to the grounding unit, the resonating unit surrounds and is positioned separate from the second radiating arm, the resonating unit resonates with the main radiator to generate two different low frequency bands corresponding to two coupling currents.

20 Claims, 3 Drawing Sheets

BROADBAND ANTENNA AND WIRELESS COMMUNICATION DEVICE EMPOLYING SAME

BACKGROUND

1. Technical Field

The exemplary disclosure generally relates to antennas, and particularly to a broadband antenna and a wireless communication device employing same.

2. Description of Related Art

With improvements in the integration of wireless communication systems, broadband antennas have become increasingly important. In order to permit a wireless communication device to utilize various frequency bandwidths, antennas having wider bandwidth have become a significant technology. A typical broadband antenna has a wide bandwidth only at high frequency band or low frequency band. It is desirable to provide a broadband band which not only has a wide high frequency bandwidth, but also has a wide low frequency bandwidth.

Therefore, there is room for improvement within the art.

BRIEF DESCRIPTION OF THE DRAWINGS

Many aspects of the embodiments can be better understood with reference to the drawings. The components in the drawings are not necessarily drawn to scale, the emphasis instead being placed upon clearly illustrating the principles of the disclosure.

DETAILED DESCRIPTION

Figure 1:
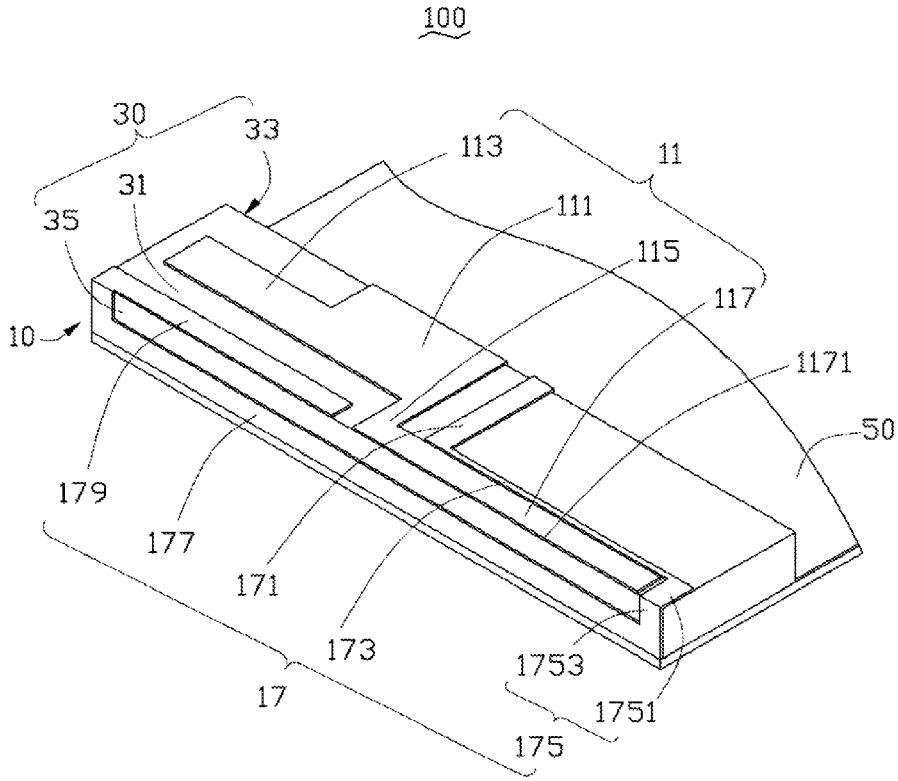
FIG. 1 is a schematic view of a wireless communication device comprising a broadband antenna, according to an exemplary embodiment.
Figure 2:
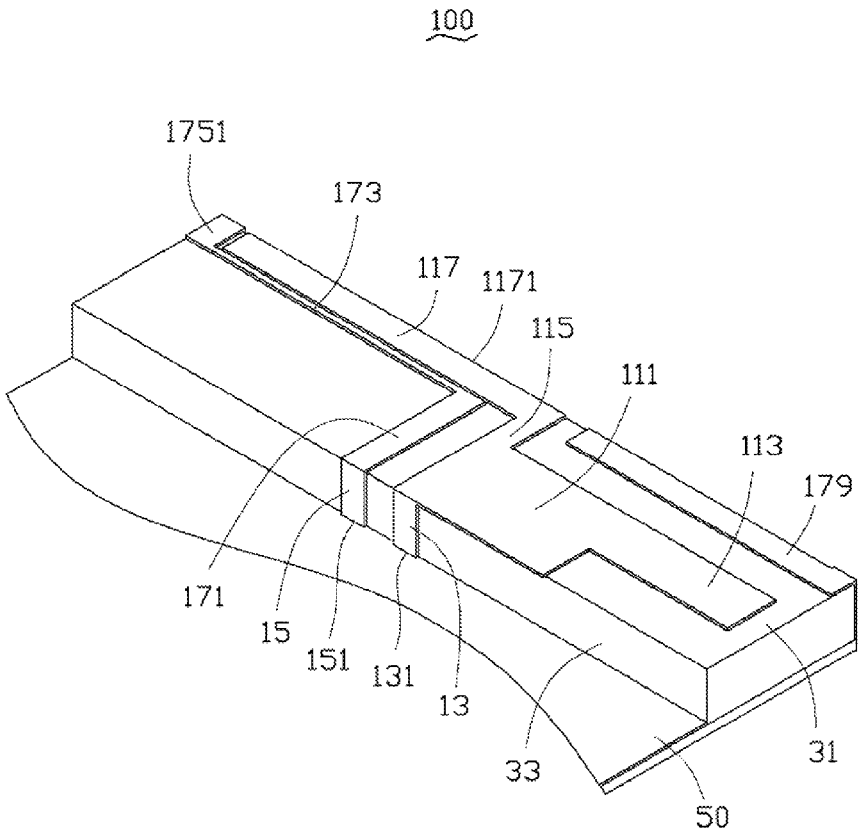
FIG. 2 is similar to FIG. 1, but showing the wireless communication device in a second view angle.

FIG. 1 is a schematic view of a wireless communication device 100, according to an exemplary embodiment. FIG. 2 is similar to FIG. 1, but showing the wireless communication device 100 in a second view angle. The wireless communication device 100 includes a broadband antenna 10, a holder 30, and a circuit board 50. The broadband antenna 10 is mounted on the holder 30, and is electronically connected to the circuit board 50. The holder 30 is positioned on the circuit board 50. The holder 30 includes a surface 31 opposite to and parallel with the circuit board 50, a first edge 33 and an opposite second edge 35.

The broadband antenna 10 includes a main radiator 11, a feeding unit 13, a grounding unit 15, and a resonating unit 17. The main radiator 11 is substantially planar in shape, and positioned on the surface 31 of the holder 30. The main radiator 11 includes a main radiating portion 111, a first radiating arm 113, a connecting arm 115, and a second radiating arm 117. The main radiating portion 111 is substantially a rectangular sheet, and has a side aligning with a joint of the surface 31 and the first edge 33. The first radiating arm 113 perpendicularly extends from one side of the main radiating portion 111. The connecting arm 115 perpendicularly extends from another side of the main radiating portion 111 to a joint of the surface 31 and the second edge 35, along a direction perpendicular to an extending direction of the first radiating arm 113. In the exemplary embodiment, the first radiating arm 113 is substantially a rectangular strip, and is narrower than the main radiating portion 111. The second radiating arm 117 perpendicularly extends from an end of the connecting arm 115 opposite to the main radiating portion 111 along a direction away from the first radiating arm 113. The second radiating arm 117 is an elongated planar sheet, and has a side 1171 aligning with the joint of the surface 31 and the second edge 35. The second radiating arm 117 is narrower than the first radiating arm 113.

The feeding unit 13 (shown in FIG. 2) is substantially a rectangular planar sheet, and extends from the side of the main radiating portion 111 opposite to the connecting arm 115. The feeding unit 13 is positioned in a plane that is perpendicular to a plane in which the main radiating portion 111 is positioned. The feeding unit 13 is mounted on the first edge 33 of the holder 30. The feeding unit 13 includes a feeding point 131 positioned at a distal end of the feeding unit 13. The feeding point 131 is electronically connected to the circuit board 50 to feed input current signal.

The grounding unit 15 is substantially a rectangular planar sheet. The grounding unit 15 is parallel with and spaced apart from the feeding unit 13, and is positioned in the plane in which the feeding unit 13 is positioned. The grounding unit 15 includes a grounding point 151 positioned at a distal end of the grounding unit 15. The grounding point 15 is grounded via the circuit board 50. The other end of the grounding unit 15 is connected to the resonating unit 17.

The resonating unit 17 surrounds and is spaced apart from the second radiating arm 117. The resonating unit 17 resonates with the main radiator 11 to generate two different low frequency modes corresponding to two coupling currents with different phases, such that a low frequency bandwidth is broadened.

In particular, the resonating unit 17 includes a first resonating arm 171, a second resonating arm 173, a third resonating arm 175, a fourth resonating arm 177, and a extension arm 179, all of which are connected in series and are substantially planar sheets. The first resonating arm 171, the third resonating arm 173, and the extension arm 179 have a same width, the second resonating arm 173 is narrower than the first resonating arm 171. The first resonating arm 171 and the second resonating arm 173 are positioned on the surface 31 of the holder 30, and are coplanar with the main radiator 11. The first resonating arm 171 perpendicularly extends from the grounding unit 15, and is spaced apart from and parallel with the main radiating portion 111 of the main radiator 11. The second resonating arm 173 perpendicularly extends from one end of the first resonating arm 171 opposite to the grounding unit 15, and is spaced apart from and parallel with the second radiating arm 117. The third resonating arm 175 is substantially an L-shaped sheet, which includes a first end 1751 and a second end 1753 perpendicular to the first end 1751. The first end 1751 perpendicularly extends from a distal end of the second resonating arm 173. The first end 1751 coplanar with the second resonating arm 173, and is positioned at an outer side of a distal end of the second radiating arm 117. The first end 1751 is positioned on the surface 31 of the holder 30. The second end 1753 and the fourth resonating arm 177 are positioned on the second edge 35 of the holder 30. The fourth resonating arm 177 perpendicularly extends from the second end 1753 towards the main radiator 11, such that the second radiating arm 117 is surrounded by the second, third, and fourth resonating arms 173, 175 and 177, and thus the second radiating arm 117 can resonate with both of the second resonating arm 173 and the fourth resonating arm 177. The fourth resonating arm 177 is parallel with the side 1171 of the second radiating arm 117, and a distal end of the fourth resonating arm 177 is level with a distal end of the first radiating arm 113.

The extension arm 179 extends from the fourth resonating arm 177, to increase a length of a current path of the broadband antenna 10. The extension arm 179 perpendicularly extends from a distal end of the fourth resonating arm 177 to the plane in which the main radiator 11 is positioned, and then perpendicularly formed towards the second radiating arm 117 in the plane in which the main radiator 11 is positioned.

In use, current signals are fed to the feeding unit 13, two current paths are formed on the first radiating arm 113 and the second radiating arm 117 respectively, to generate two different high-frequency modes, such that a high frequency bandwidth of the broadband antenna has been broadened. In the exemplary embodiment, the broadband antenna 10 is capable of transmitting high frequency signals with frequencies from about 1710 MHz to 2600 MHz. Accordingly, wireless communication device 100 employing the broadband antenna 10 can be used in common wireless communication systems, such as GSM (1800/1900 MHz), WCDMA Band 1 (2100 MHz), LTE Band 1 (2100 MHz), and LTE Band 7 (2600 MHz), with acceptable communication quality. In addition, the high frequency bandwidth of the broadband antenna 10 can be further broadened by regulating a shape and size of the first radiating arm 113, such as, a shape of the first radiating arm 113 is changed to a triangle-shaped planar sheet.

Simultaneously, a distance between the grounding unit 15 and the feeding unit 13, a distance between the second resonating arm 173 and the second radiating arm 117, and a distance between the fourth resonating arm 177 and the side 1171 of the second radiating arm 117 are adjusted to ensure that when a input current signal is fed to the feeding unit 13, two coupling current signals with different phases are generated and flows through the resonating unit 17. A phase of the a first coupling current flowing through the resonating unit 17 is counter with the phase of the input current signal, the resonating unit 17 resonates with the main radiator 11 to generate a first low frequency band; a phase of a second coupling current flowing through the resonating unit 17 is the same as the phase of the input current signal, the resonating unit 17 resonates with the main radiator 11 to generate a second low frequency band; such that the resonating unit 17 can resonate with the main radiator 11 to generate two different low frequency modes, and thus the low frequency bandwidth of the broadband antenna 10 has been broadened. In the exemplary embodiment, the broadband antenna 10 is capable of transmitting low frequency signals with frequencies from about 704 MHz to 960 MHz. Accordingly, wireless communication device 100 employing the broadband antenna 10 can be used in common wireless communication systems, such as GSM (850/900 MHz) and LTE Band 13/17 (700 MHz), with exceptional communication quality.

Figure 3:
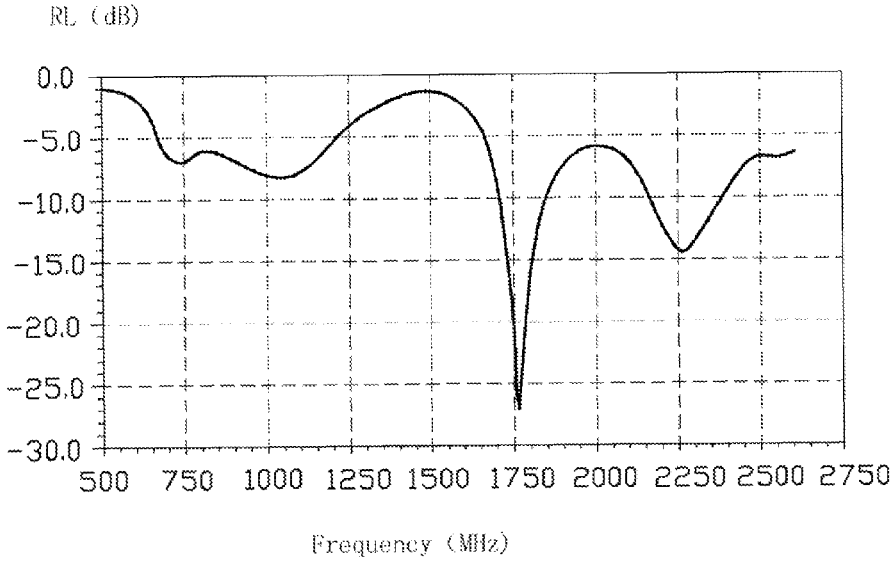
FIG. 3 is a diagram showing return loss (RL) measurement of the broadband antenna shown in FIG. 1.

FIG. 3 is a diagram showing return loss (RL) measurement of the broadband antenna 10 shown in FIG. 1. As shown in FIG. 3, the broadband antenna 10 generates two low frequency modes at about 750 MHz and 1000 MHz, and generates two high frequency modes at about 1750 MHz and 2250 MHz, and can achieve high transmission efficiency at each frequency band.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A broadband antenna, comprising:

a main radiator comprising a main radiating portion, a first radiating arm extending from the main radiating portion, and a second radiating arm extending from the main radiating arm, the first radiating arm forming a first current path to generate a first high frequency mode, the second radiating portion forming a second current path to generate a second high frequency mode;

a grounding unit that is grounded;

a feeding unit extending from the main radiating portion; and a resonating unit connected to the grounding unit, wherein the resonating unit surrounds and is positioned separate from the second radiating arm, the resonating unit resonates with the main radiator to generate two different low frequency bands corresponding to two coupling currents.

2. The broadband antenna of claim 1, wherein the main radiator further comprising a connecting arm, the first radiating arm perpendicularly extends from one side of the main radiating portion; the connecting arm perpendicularly extends from another side of the main radiating portion along a direction perpendicular to the first radiating arm; the second radiating arm perpendicularly extends from an end of the connecting arm opposite to the main radiating portion along a direction away from the first radiating arm.

3. The broadband antenna of claim 2, wherein the main radiating portion is coplanar with the first radiating arm, the connecting arm, and the second radiating arm.

4. The broadband antenna of claim 2, wherein the feeding unit is extended from a side of the main radiating portion opposite to the connecting arm.

5. The broadband of claim 4, wherein the feeding unit is positioned in a plane that is perpendicular to a plane in which the main radiating portion is positioned.

6. The broadband antenna of claim 1, wherein the grounding unit is parallel with and coplanar with the feeding unit.

7. The broadband antenna of claim 1, wherein the resonating unit comprises a first resonating arm and a second resonating arm, the first resonating arm is perpendicularly connected to the ground portion and is parallel with the main radiating portion; the second resonating arm perpendicularly extends from one end of the first resonating arm opposite to the grounding unit, and is spaced apart from and parallel with the second radiating arm.

8. The broadband antenna of claim 7, wherein the resonating unit further comprises a third resonating arm, the third resonating arm comprises a first end and a second end perpendicular to the first end, the first end is perpendicularly extends from a distal end of the second resonating arm, the first end coplanar with the second resonating arm, and is positioned at an outer side of a distal end of the second radiating arm, the second end is positioned in a plane that is perpendicular to a plane in which the first end is positioned.

9. The broadband antenna of claim 8, wherein the resonating unit further comprises a fourth resonating arm that perpendicularly extends from and coplanar with the second end towards the main radiator.

10. The broadband antenna of claim 9, wherein the resonating unit further comprises an extension arm perpendicularly extends from a distal end of the fourth resonating arm to the plane in which the main radiator is positioned, and then perpendicularly formed towards the second radiating arm in the plane in which the main radiator is positioned.

11. A wireless communication device, comprising:

a circuit board;

a holder; and a broadband antenna positioned on the holder and comprising:

a main radiator comprising a main radiating portion, a first radiating arm extending from the main radiating portion, and a second radiating arm extending from the main radiating arm, the first radiating arm forming a first current path to generate a first high frequency mode, the second radiating arm forming a second current path to generate a second high frequency mode;

a grounding unit that is grounded via the circuit board;

a feeding unit extending from the main radiating portion and electronically connected to the circuit board; and a resonating unit connected to the grounding unit, wherein the resonating unit surrounds and is positioned separate from the second radiating portion, the resonating unit resonates with the main radiator to generate two different low frequency bands corresponding to two coupling currents.

12. The wireless communication device of claim 11, wherein the main radiator further comprising a connecting arm, the first radiating arm perpendicularly extends from one side of the main radiating portion; the connecting arm perpendicularly extends from another side of the main radiating portion along a direction perpendicular to the first radiating arm; the second radiating arm perpendicularly extends from an end of the connecting arm opposite to the main radiating portion along a direction away from the first radiating arm.

13. The wireless communication device of claim 12, wherein the main radiating portion is coplanar with the first radiating arm, the connecting arm, and the second radiating arm.

14. The wireless communication device of claim 12, wherein the feeding unit is extended from a side of the main radiating portion opposite to the connecting arm.

15. The wireless communication device of claim 14, wherein the feeding unit is positioned in a plane that is perpendicular to a plane in which the main radiating portion is positioned.

16. The wireless communication device of claim 11, wherein the grounding unit is parallel with and coplanar with the feeding unit.

17. The wireless communication device of claim 11, wherein the resonating unit comprises a first resonating arm and a second resonating arm, the first resonating arm is perpendicularly connected to the ground portion and is parallel with the main radiating portion; the second resonating arm perpendicularly extends from one end of the first resonating arm opposite to the grounding unit, and is spaced apart from and parallel with the second radiating arm.

18. The wireless communication device of claim 17, wherein the resonating unit further comprises a third resonating arm, the third resonating arm comprises a first end and a second end perpendicular to the first end, the first end is perpendicularly extends from a distal end of the second resonating arm, the first end coplanar with the second resonating arm, and is positioned at an outer side of a distal end of the second radiating arm, the second end is positioned in a plane that is perpendicular to a plane in which the first end is positioned.

19. The wireless communication device of claim 18, wherein the resonating unit further comprises a fourth resonating arm that perpendicularly extends from and coplanar with the second end towards the main radiator.

20. The wireless communication device of claim 19, wherein the resonating unit further comprises an extension arm perpendicularly extends from a distal end of the fourth resonating arm to the plane in which the main radiator is positioned, and then perpendicularly formed towards the second radiating arm in the plane in which the main radiator is positioned.

* * * * *